US005664515A

United States Patent [19]

Hattori et al.

[11] Patent Number: 5,664,515

[45] Date of Patent: Sep. 9, 1997

[54] VENTILATING ARRANGEMENT FOR WATERCRAFT

[75] Inventors: Toshiyuki Hattori; Fumihiko Ebihara, both of Iwata, Japan

[73] Assignee: Yamaha Hatsudoki Kabushiki Kaisha, Iwata, Japan

[21] Appl. No.: 554,846

[22] Filed: Nov. 7, 1995

[30] Foreign Application Priority Data

Nov. 9, 1994 [JP] Japan ..... 6-274811

[51] Int. Cl.[6] ..... B63J 2/00

[52] U.S. Cl. ..... 114/211; 114/270

[58] Field of Search ..... 440/38, 88, 89; 114/270, 211; 60/221, 222, 310

[56] References Cited

U.S. PATENT DOCUMENTS 4,635,582 1/1987 Nishida ..... 440/88

4,982,682 1/1991 Hattori ..... 440/89

4,984,528 1/1991 Kobayashi ..... 440/88

*Primary Examiner*—Edwin L. Swinehart

*Attorney, Agent, or Firm*—Knobbe, Martens, Olson & Bear LLP

[57] ABSTRACT

A small, personal watercraft having an improved ventilating system that provides not only ventilating air but also a shroud for an instrument of the watercraft. A compact exhaust system is also provided that extends on opposite sides of a tunnel in which the jet propulsion unit which powers the watercraft is positioned. Transfer pipes extend across the tunnel and across the watercraft to transfer the exhaust gases from the exhaust manifold to the watercraft trap device and also for providing traps to preclude water from entering the engine through the exhaust system.

31 Claims, 6 Drawing Sheets

VENTILATING ARRANGEMENT FOR WATERCRAFT

BACKGROUND OF THE INVENTION

This invention relates to a ventilating system for a watercraft and more particularly to an improved engine compartment ventilating for such watercraft and an improved exhaust system for this type of watercraft.

As is well known, engines powered by internal combustion engines that are mounted inboard of the hull and within an engine compartment require adequate ventilation of the engine compartment. It is desirable to ensure that adequate air can reach the engine for combustion and also so as to purge the engine compartment from unwanted vapors. This problem, although easily handled with larger watercraft, presents a number of problems in conjunction with a smaller type of watercraft known as a "personal watercraft."

Personal watercraft are a relatively small type of watercraft wherein the rider sits more upon than in the watercraft. This type of watercraft is designed to be operated primarily by a single rider although accommodations are frequently made for one or more passengers in addition to the operators. With this type of watercraft, the engine compartment is frequently formed below the rider's area or immediately forwardly of it.

This type of watercraft is quite sporting in nature and thus the rider and passengers frequently wear swimming suits when riding this type of watercraft. Thus, they expect to receive a fairly large amount of water spray during the watercraft operation. As a result of this, there is a fair amount of water spray around the environment of the watercraft and this can easily enter the engine compartment through the ventilating system. Of course, it is desirable to protect the engine and its auxiliaries from this water. Various arrangements have been proposed, therefore, for providing ventilation of the engine compartment while, at the same time, precluding water ingestion.

With the small type of watercraft involved, it is important to ensure adequate ventilating airflow but also to ensure that water will not enter the engine compartment through the ventilating system. For the reasons aforenoted, this is particularly difficult with personal-type watercraft.

It is, therefore, a principal object of this invention to provide an improved engine compartment ventilating system for a personal watercraft.

It is a further object of this invention to provide a ventilating arrangement for a personal watercraft that will provide adequate ventilation and also will provide good assurance that water will not be inadvertently drawn into the engine compartment along with the ventilating air.

With this type of watercraft, the hull is generally made up of two major components, a lower hull under portion and an upper deck portion. The engine compartment is normally formed between these two hull portions. Because of this type of construction, it is relatively difficult to provide a good ventilating system that will achieve the aforenoted effects.

It is, therefore, a still further object of this invention to provide an improved hull configuration for this type of watercraft wherein an adequate and yet highly waterproof ventilating system is provided.

In addition to the problem of adequate ventilation of the engine compartment, the handling of the exhaust gases for this type of watercraft also presents problems that are unique because of the size and nature of use of this type of watercraft. This type of watercraft is often powered by a jet propulsion unit which is mounted in a tunnel to the underside of the hull. This type of propulsion unit offers a number of advantages but the intrusion of the tunnel into the hull area further reduces the space available for the exhaust system components.

Also, it is the general practice to discharge the exhaust gases to the atmosphere from marine engines either at or below the water level. This assists in the silencing of the exhaust gases. Furthermore, it is the normal practice to discharge the water from engine cooling jacket into the exhaust system so as to simplify the fluid handling and to cool the exhaust gases and provide additional silence.

All of these factors, however, add to the risk that water may enter the engine through the exhaust system. This problem is further compounded by the fact that this type of watercraft frequently may become capsized and the occupants and users recognize that this is a distinct possibility. Therefore, some type of arrangement is normally incorporated not only for silencing the exhaust gases but also for ensuring against water entering the engine through the exhaust system. Of course, these components have specific spatial requirements and this gives rise to the design problems aforenoted.

It is, therefore, a still further object of this invention to provide an improved exhaust system for a personal watercraft.

It is a further object of this invention to provide an exhaust system for a personal watercraft that can have sufficient length and yet incorporate devices for ensuring that water cannot reach the engine through the exhaust system including water that may be discharged from the engine cooling jacket into the exhaust system.

SUMMARY OF THE INVENTION

The features of this invention are adapted to be embodied in a personal watercraft that is comprised of a hull having an under-hull portion and a deck portion affixed together to define an engine compartment that contains an internal combustion engine. At least one engine accessory is also provided in the engine compartment. A propulsion device is driven by the engine for propelling the watercraft. A rider's area is disposed to the rear of the hull and is defined at least in major part by the deck portion.

In accordance with a first feature of the invention, a forward part of the deck portion defines a ventilating air inlet that faces in a generally forward direction. An air cavity is formed by the deck portion at least in part above the engine compartment and receives ventilating air from the ventilating air inlet. A ventilating air inlet conduit extends generally downwardly from the cavity at a point above its lowermost surface and in proximity to the ventilating air inlet for transferring at least a portion of the air entering the ventilating air inlet into the engine compartment. A ventilating air discharge conduit extends from a rearward portion of the engine compartment and discharges to the atmosphere.

Another feature of the invention is adapted to be embodied in a personal watercraft of the type described previously. In accordance with this feature, the propulsion device comprises a jet propulsion unit that is mounted at least in part in a tunnel that is formed on the underside of the hull under portion and to the rear thereof. This jet propulsion unit has an impeller shaft that extends forwardly for coupling to an output shaft of the engine for driving of an impeller of the jet propulsion unit. The engine is positioned so that it has exhaust ports extending through one side thereof for discharging exhaust gases from the engine combustion. A combined exhaust manifold and expansion chamber collects the exhaust gases from the exhaust ports and extends upwardly and rearwardly toward the rear portion of the engine and on one side of a longitudinal plane thereof. A water trap device is disposed the other side of the longitudinal plane and adjacent the tunnel but within the hull. A first transfer pipe extends from an end of the exhaust manifold and expansion chamber device upwardly and transversely across the propeller shaft and enters the water trap device. A second transfer pipe extends from the water trap device upwardly and transversely across the upper portion of the tunnel and terminates at a discharge end that enters into the tunnel. The two transfer pipes therefore act as traps to assist in precluding water from entering the engine through the exhaust system.

DETAILED DESCRIPTION OF THE PREFERRED EMBODIMENT OF THE INVENTION

Figure 1:
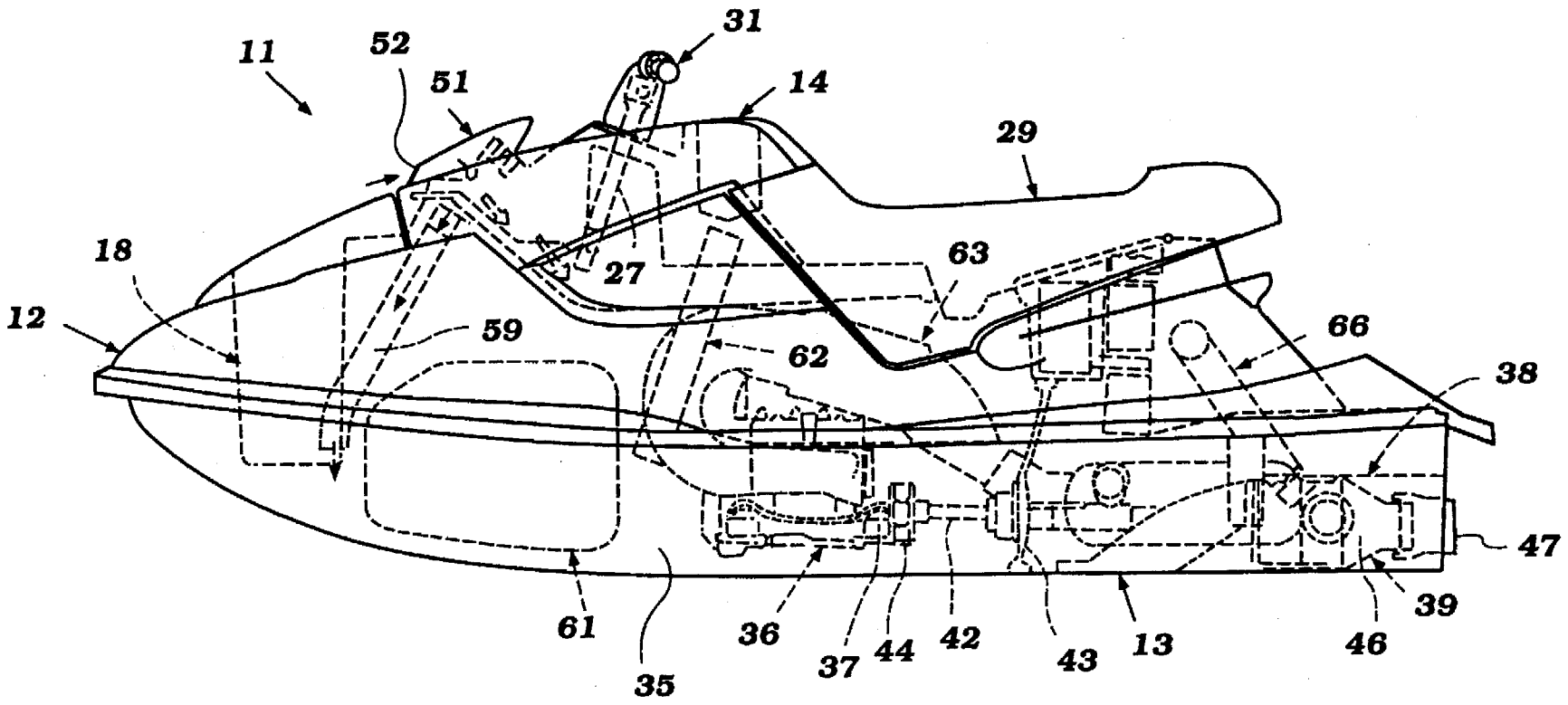
FIG. 1 is a side elevational view of a personal watercraft constructed in accordance with an embodiment of the invention.
Figure 2:
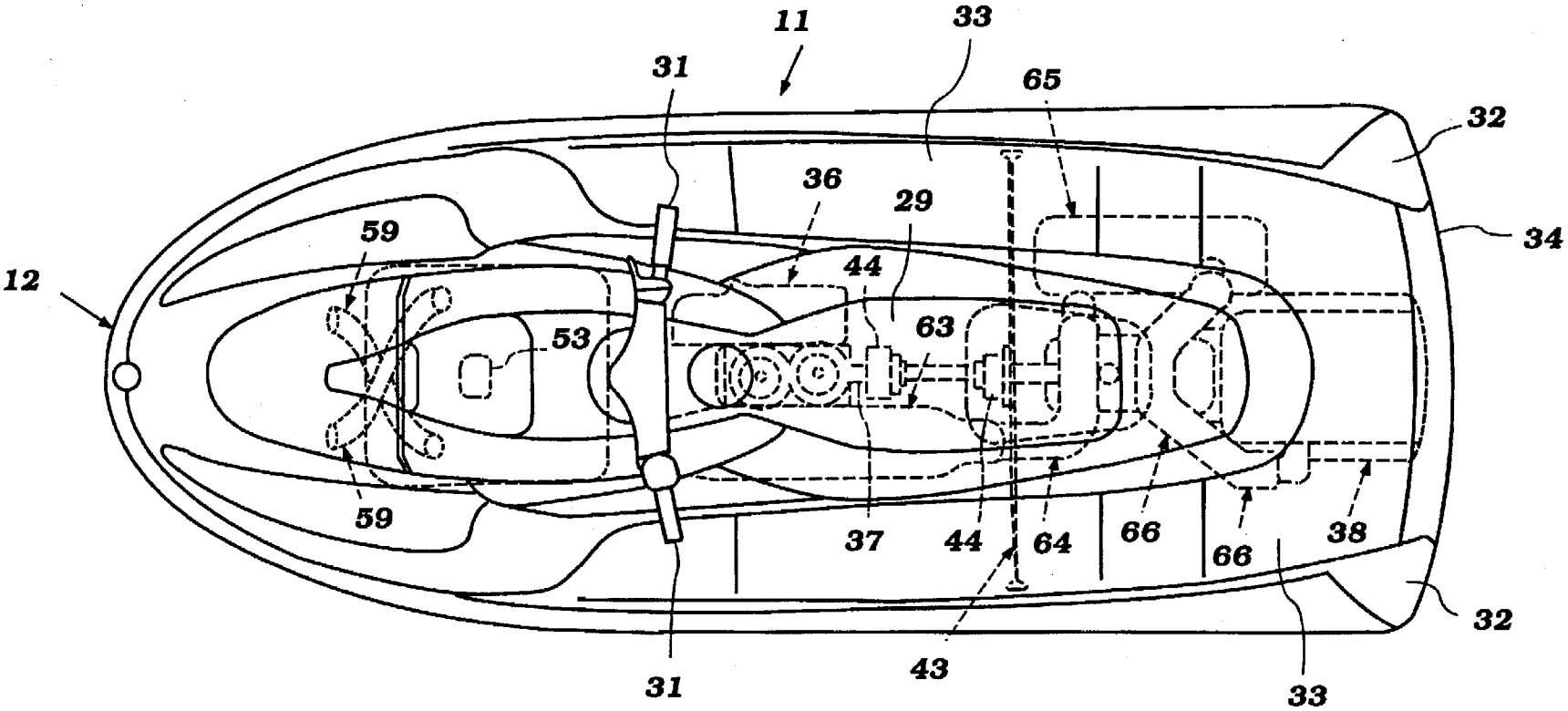
FIG. 2 is a top plan view thereof.

Referring now in detail to the drawings and initially to FIGS. 1, 2, 3, and 5, a personal watercraft constructed in accordance with an embodiment of this invention is identified generally by the reference numeral 11. The watercraft 11 is comprised of a hull, indicated generally by the reference numeral 12, and comprised primarily of a lower hull portion 13 and an upper deck assembly 14. The upper deck assembly 14 is comprised of a lower deck portion 15, an intermediate deck portion 16, and an upper deck portion 17. The lower deck 15 sealingly engages the lower hull 13 around its periphery in any suitable manner and defines a storage area 18 at its forward end that is sealed by a cover 19 in any known-manner. At its rearward end the lower deck 15 defines a battery cage 21 in which is positioned a battery 22, and a fire extinguisher housing 23 in which is positioned a fire extinguisher 24.

The intermediate deck 16 pivotally engages the lower deck 15 at its forward end by means of a hinge assembly 25. In this manner, access to an engine compartment, indicated generally by the reference numeral 35, is possible. The intermediate deck 16 also has an upstanding portion 26 through which a control mast 27 for control of the watercraft 11 extends.

The upper deck 17, in which is positioned an instrument 28 for monitoring the mechanical operation of the watercraft 11, is mounted on top of the intermediate deck 16 in a sealing manner at those locations along its periphery that contact the upper surface of the intermediate deck 16. The hull and deck portion, 13 and 14 respectively, may be formed from any suitable material such as a molded fiberglass reinforced resinous plastic or the like.

The upper deck assembly 14 has a rider's area at its rear end at which a seat 29 is provided for accommodating one or more riders seated in straddle tandem fashion. Controls for operating the watercraft 11 are disposed forwardly of the seat 29 and include a handle bar assembly 31 which connects to the control mast 27 and controls the steering of the watercraft 11 and may additionally contain throttle control for the powering internal combustion engine.

A pair of raised gunnels 32 are formed at opposite sides of the rear portion of the upper deck assembly 14 and define a pair of foot areas 33 into which the riders may place their feet. The rear of the foot areas 33 are open through the rear of a transom 34 to facilitate water drainage and also to permit ease of entry and exit of the watercraft 11 from the body of water in which the watercraft 11 is operating.

The hull 12 defines an engine compartment 35 which is vented by a venting system to be described later. An internal combustion engine, identified by the reference numeral 36, is mounted in the engine compartment 35 underneath the rider's area for powering the watercraft 11. The engine 36 has an exhaust system which exhausts the combustion products and the engine cooling water from the water jackets to the atmosphere in a manner to be described in detail later. The engine 36 also has an output shaft 37.

Figure 6:
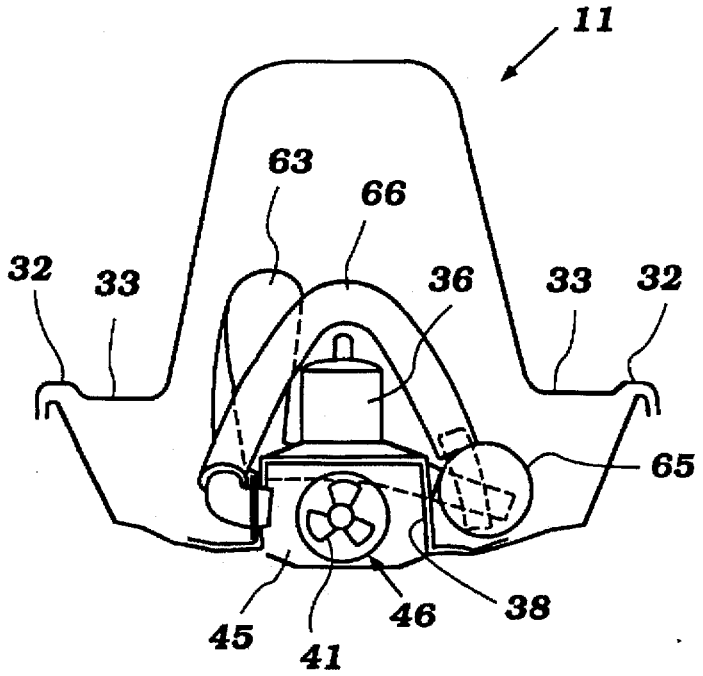
FIG. 6 is a view taken generally along the line 6—6 of FIG. 4 and shows the exhaust system and its relation to the tunnel.
Figure 7:
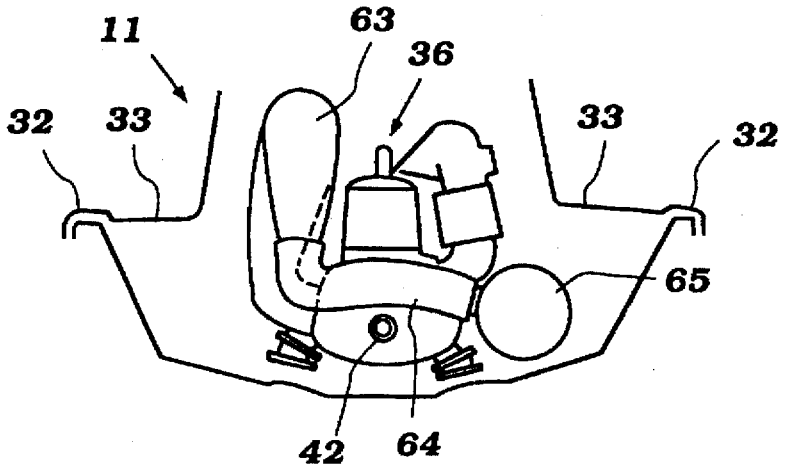
FIG. 7 is a view, in part similar to FIG. 6, that is taken along the line 7—7 of FIG. 4.

A tunnel 38 is formed on the underside of the lower hull portion 13 at its rearward end. The tunnel 38 opens through the rear of the transom 34 as is clearly shown in FIG. 6. A jet propulsion unit, identified by the reference numeral 39, is mounted within the tunnel 38 for propelling the watercraft 11. The jet propulsion unit includes an impeller 41 which draws water from the body of water in which the watercraft 11 is operating. The impeller 41 is affixed to an impeller shaft 42 which extends forwardly through a bulkhead 43 from the tunnel 38 into the engine compartment 35. The impeller shaft 42 is coupled by means of a flexible coupling 44 to the engine output shaft 37 for driving the impeller 41.

Water pumped by the impeller 41 is discharged rearwardly through an opening 45 formed at the rear of the tunnel 38 in the transom 34 through a discharge nozzle portion 46 of the jet propulsion unit 391 A pivotally supported steering nozzle 47 is supported in registry with the discharge nozzle 46 and is steered by the handle bar assembly 31 for steering of the watercraft 11 in a well known manner.

The construction of the watercraft 11 as thus far described may be considered to be conventional and a problem may occur where water from the operating environment may enter the engine compartment 35 through the ventilating system. An embodiment of this invention eliminates this problem by providing an improved design for the ventilating system that effectively separates the venting atmospheric air from the water spray from the operating environment.

Figure 3:
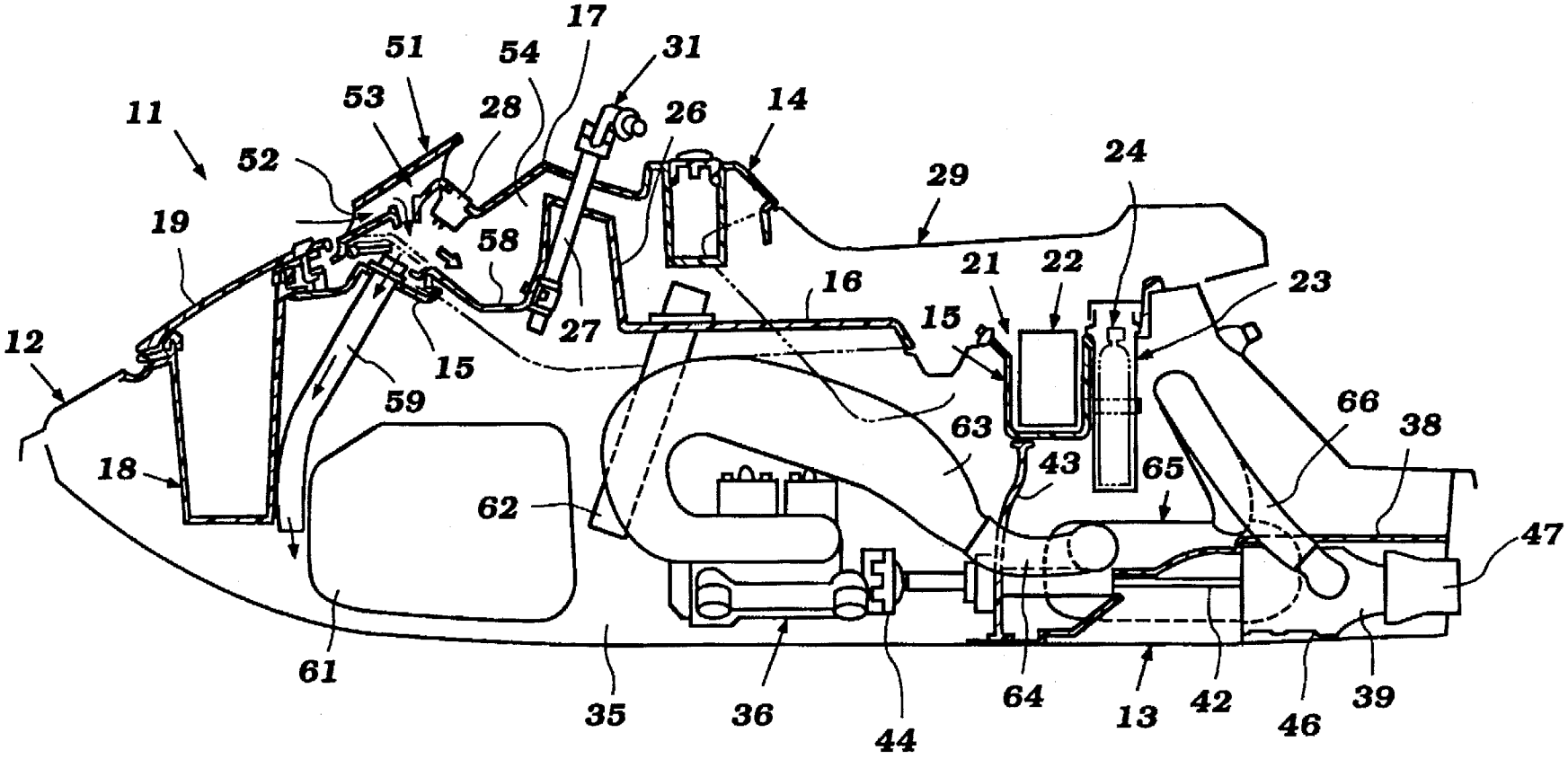
FIG. 3 is a cross-sectional view looking generally in the same direction as FIG. 1 and shows the location of the various components in the engine compartment, the ventilating system therefore and the exhaust system for the engine.
Figure 5:
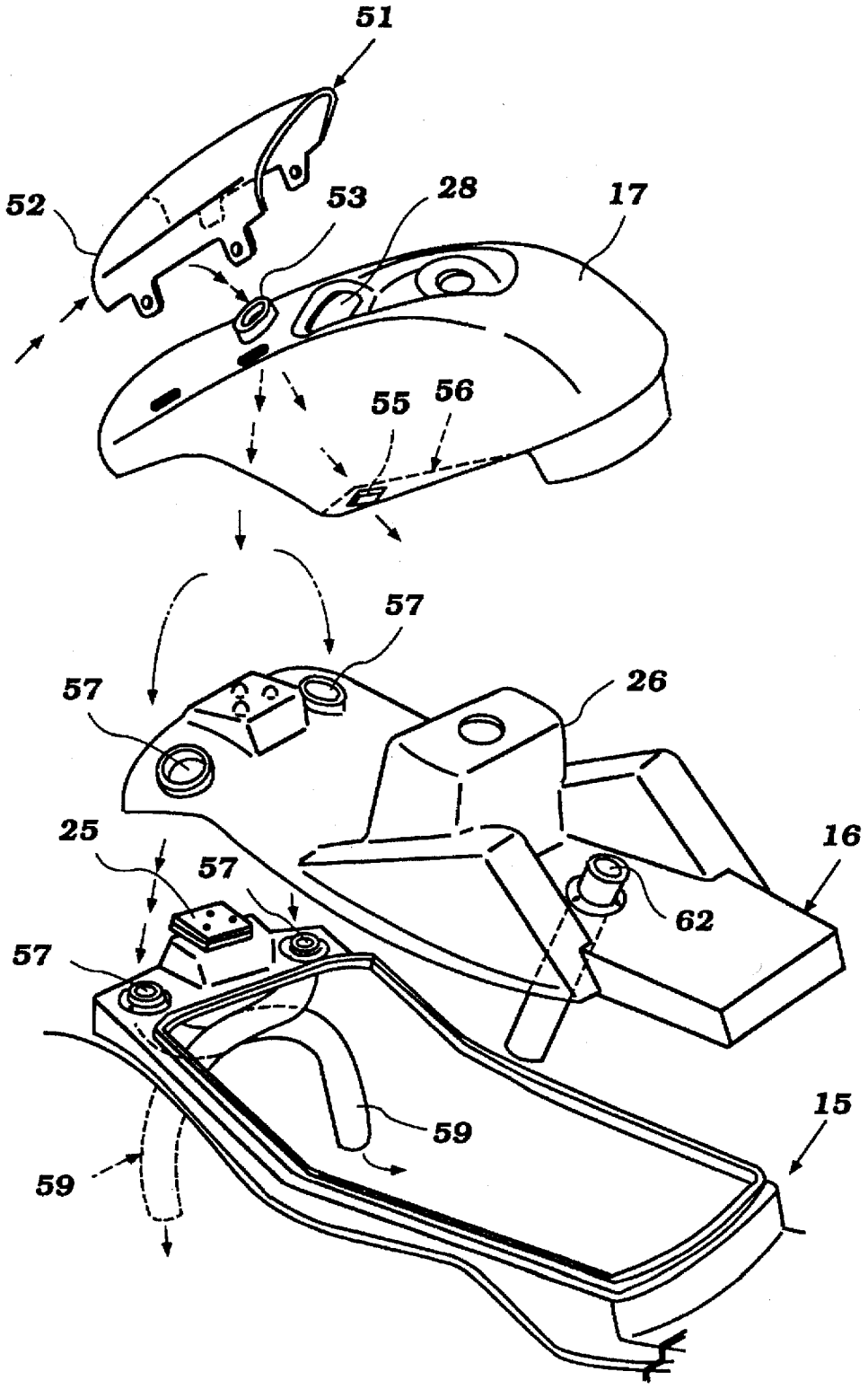
FIG. 5 is an exploded perspective view of a part of the hull construction showing how the ventilating arrangement is constructed.

Referring now to the ventilating system as shown in detail in FIGS. 3 and 5 a shroud 51 is mounted atop the front portion of the upper deck 17. The front of the shroud 51 is open and defines the ventilating air inlet 52. A lipped air inlet opening 53 is positioned on the front portion of the upper deck 17 under the shroud 51 and opens into an air cavity 54 which comprises the space between the upper deck 17 and the intermediate deck 16. A water exit hole 55 is positioned in a flange 56 which forms the small bottom surface of the upper deck 17.

A pair of ventilating air inlet conduit holes 57 are formed through the intermediate and lower decks, 16 and 15 respectively, at the forward portion of the cavity 54 above and ahead of the cavity well 58. Ventilating air inlet conduits 59 sealingly engage at their upper ends to the ventilating air inlet conduit access holes 57 and cross over each other while extending generally downwardly and forwardly into the front portion of the engine compartment 35 ahead of a fuel tank 61.

A ventilating air discharge conduit 62 is positioned in the engine compartment 35 downstream of the ventilating air inlet conduits 59 and behind the fuel tank 61. The ventilating air discharge conduit 62 extends generally upwards and rearward and penetrates through the intermediate deck 16 into the rearmost portion of the cavity 54.

During the normal course of operation of the watercraft 11 a supply of atmospheric air and water spray will enter the ventilating air inlet 52. Most of the water will tend to flow around the lipped air inlet opening 53 and exit the shroud 51 at its rear. A portion of the water, however, may also enter through the lipped air inlet opening 53 into the air cavity 54. This water collects at the cavity well 58 and exits the watercraft 11 through the water exit hole 55.

Some of the atmospheric air entering the ventilating air inlet 52 will simply exit again to the atmosphere through the open rear of the shroud 51 but a portion of the air will pass through the lipped air inlet opening 53 into the air cavity 54. From there the air will enter the engine compartment 35 via the ventilating air inlet conduits 59 and serve to ventilate the engine compartment 35 before passing through ventilating air discharge conduit 62 and into the rear of the cavity 54, there to vent to the atmosphere through an opening underneath the seat 29.

While the above embodiment prevents water from the operating environment from entering the engine compartment 35 through the ventilating system it is still possible that water may enter the engine 36 through the exhaust system. This water may come from the operating environment or from the engine cooling jackets, which typically discharge into the exhaust system. A further embodiment of this invention eliminates this possibility by utilizing an exhaust configuration that precludes flow back into the engine 36.

Figure 4:
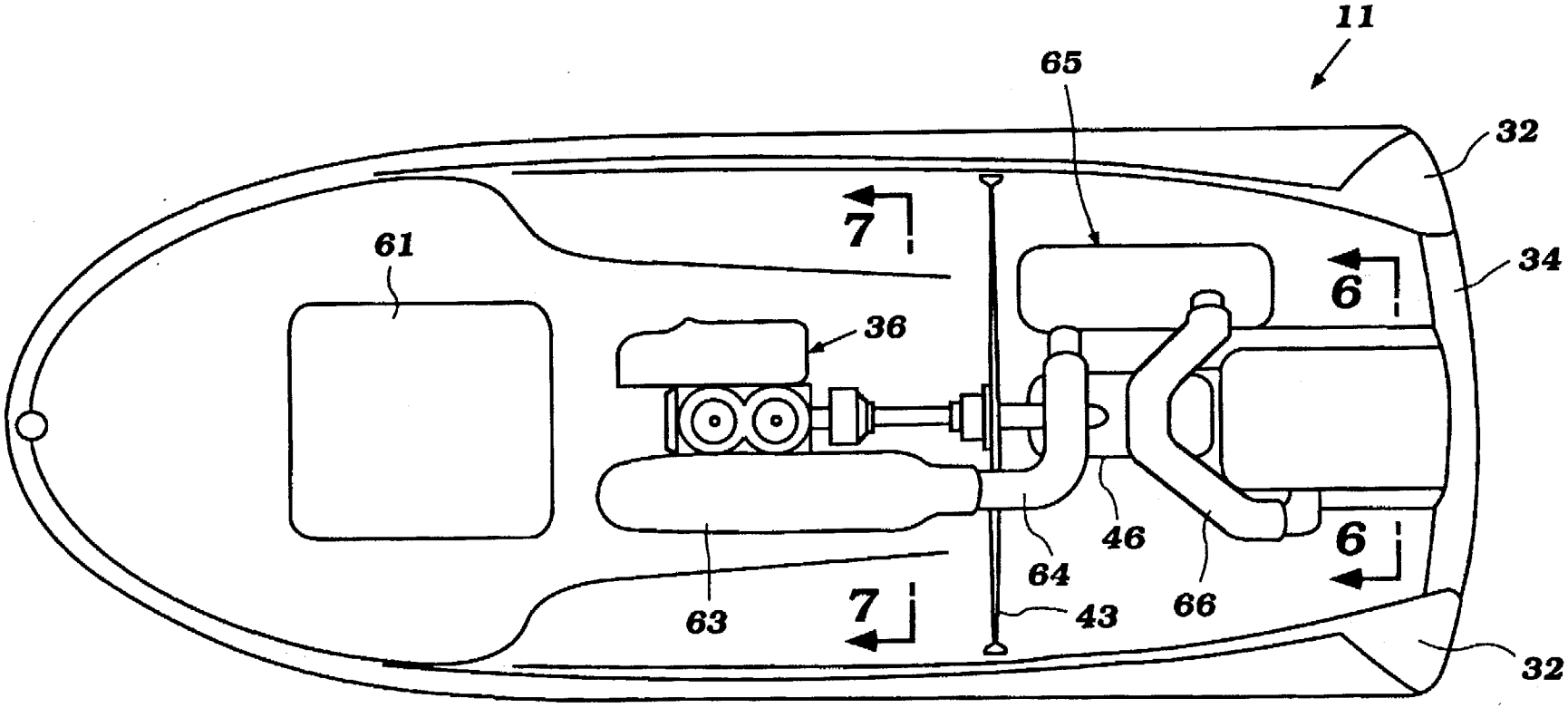
FIG. 4 is a top plan view, in part similar to FIG. 2, but shows the construction with the upper deck portion removed.

Referring now to the exhaust system as shown in FIGS. 3, 4, 6, and 7 a combination exhaust manifold and expansion chamber 63 is mounted to one side of the engine 36 and extends first in an upwardly direction, then rearwardly and downwardly to connect at its lower end to a crossover pipe 64. As is best seen in FIG. 4 the crossover pipe 64 transverses to the opposite side of the tunnel 38 and connects to the forward upper portion of a watertrap 65. A transfer pipe 66 connects to the watertrap 65 at its rearward upper end. The transfer pipe 66 transverses the tunnel 38 and connects at its rearward end to the side of the propulsion unit 39.

The engine exhaust gases and water coolant are forcibly expelled by the engine 36 into the combination exhaust manifold and expansion chamber 63 and route to the watertrap 65 via the crossover pipe 64. The exhaust gas and water then enter the transfer pipe 66 which vents the exhaust gas and water through the propulsion unit 39 to the operating environment.

From the above it is clearly evident that water cannot enter the engine 36 when the engine 36 is operating in a normal manner, since under these conditions the flow of coolant water is away from the engine 36. In situations where the engine 36 is shut off the water remaining in the exhaust system will tend mostly to collect at the system's lowest point, namely the watertrap 65. At the same time, water from the operating environment will be gravitationally bound to the lower end of the transfer pipe 66. In the extreme case where the watercraft 11 is capsized, any water remaining in the exhaust system will collect in the crossover pipe 66 and the upper (when upright) portion of the combination exhaust manifold and expansion chamber 63 but will be gravitionally restrained from climbing up into the engine 36.

From the foregoing description it should be readily apparent that the described construction provides a very effective and easily formed ventilating and exhaust system for a personal watercraft that will be highly efficient and yet compact in nature. Of course, the foregoing description is that of a preferred embodiment of the invention and various changes and modifications may be made without departing from the spirit and scope of the invention, as defined by the appended claims.

What is claimed is:

1. A personal watercraft comprised of a hull having an under-hull portion and a deck portion affixed together to define an engine compartment containing an internal combustion engine and at least one accessory therefor, a propulsion device driven by said engine for propelling said watercraft, a rider's area disposed to the rear of said hull and defined at least in major part by said deck portion, a forward part of said deck portion defining a ventilating air inlet, a longitudinally extending cavity formed by said deck portion at least in part above said engine compartment and receiving ventilating air from said ventilating air inlet, an upstanding wall separating said cavity into a forward portion communicating with said ventilating air inlet and a rearward portion, a ventilating inlet air conduit extending generally downwardly from said forward portion of said cavity from a point above the lower end thereof for delivering ventilating air to the engine compartment, a ventilating exhaust air conduit extending upwardly from a rear portion of said engine compartment to said rearward portion of said cavity, and means for communicating said rearward portion with the atmosphere.

2. A personal watercraft as set forth in claim 1, wherein the ventilating air inlet is formed by a portion of the hull that defines a generally open discharge part of the rear of the forward portion of the cavity and rearwardly of the ventilating air inlet, said discharge part overlying a wall that defines the upper portion of the cavity and further including an opening in the wall for delivering air to the cavity.

3. A personal watercraft as set forth in claim 2, wherein the ventilating air inlet is disposed forwardly of the rider's area.

4. A personal watercraft as set forth in claim 3, further including an instrument for providing information regarding the watercraft operation to the operator and disposed contiguous to the discharge end.

5. A personal watercraft as set forth in claim 4, wherein the ventilating air inlet defining portion forms a shroud over the instrument.

6. A personal watercraft as set forth in claim 5, wherein the hull defines a storage compartment forwardly of the ventilating air inlet and spaced therefrom.

7. A personal watercraft as set forth in claim 1, wherein the hull defines a storage compartment forwardly of the ventilating air inlet and spaced therefrom.

8. A personal watercraft as set forth in claim 1, wherein there are a pair of ventilating inlet air conduits extending from the forward portion of the cavity to the engine compartment.

9. A personal watercraft as set forth in claim 8, wherein each of the ventilating air conduits opens into the cavity on one side of a longitudinally extending plane of the watercraft and terminates on the other side thereof so that the ventilating inlet air conduits cross over each other.

10. A personal watercraft as set forth in claim 9, wherein the cavity is formed with a well to the rear of and below the upper openings of the ventilating air conduits.

11. A personal watercraft as set forth in claim 10, wherein the cavity extends rearwardly from its lowermost portion to an area beneath a seat for a rider disposed in the rider's area.

12. A personal watercraft as set forth in claim 11, wherein the ventilating exhaust air conduit discharges into the portion of the cavity beneath the seat.

13. A personal watercraft as set forth in claim 1, further including means for forming a shroud over the discharge end of the ventilating exhaust air conduit for precluding water entry there into.

14. A personal watercraft as set forth in claim 1, wherein the propulsion unit comprises a jet propulsion unit mounted at least in part in a tunnel formed on the rear part of the hull underside portion and driven by the engine.

15. A personal watercraft as set forth in claim 14, wherein the engine has at least one exhaust port opening through one side of a longitudinally extending plane of the hull, an exhaust manifold, expansion chamber device and first transfer pipe for receiving exhaust gases from said exhaust port and discharging them upwardly, and to the other side of the longitudinal plane, a watertrap device positioned on said plane other side and extending at least in part along one side of said tunnel and receiving exhaust gases from said first transfer pipe, and a second transfer pipe having a generally inverted U-shaped section and extending from a rearward portion of the watertrap device across the upper end of said runnel and discharging the exhaust gases to the atmosphere.

16. A personal watercraft as set forth in claim 15, wherein the second transfer pipe discharges the exhaust gases into the tunnel.

17. A personal watercraft as set forth in claim 16, wherein the first transfer pipe extends transversely across the watercraft and extends vertically above an impeller shaft of the jet propulsion unit which is driven by the engine output shaft.

18. A personal watercraft, comprised of a hull having an under-hull portion and a deck portion affixed together to define an engine compartment containing an internal combustion engine and at least one accessory therefor, a propulsion device driven by said engine for propelling said watercraft, a rider's area disposed to the rear of said hull and defined at least in major part by said deck portion, a forward part of said deck portion defining a ventilating air inlet facing in a generally forward direction, a cavity formed by said deck portion at least in part above said engine compartment and receiving ventilating air from said ventilating air inlet, a ventilating inlet air conduit extending generally downwardly from said cavity from a point above the lower end thereof and contiguous to the ventilating air inlet for delivering ventilating air to the engine compartment, a ventilating exhaust air conduit extending upwardly from a rear portion of said engine compartment to the atmosphere, said upper deck portion being covered by an intermediate portion that defines the lower portion of said cavity, an upper cavity-forming portion, and a shroud-forming portion, said upper cavity forming portion having an air inlet opening for communicating said cavity with said shroud portion, said intermediate portion having an opening for communicating said cavity with said ventilating air inlet conduit.

19. A personal watercraft as set forth in claim 18, wherein the shroud comprises a generally U-shaped member and extends rearwardly over a recess in the upper cover member which recess is adapted to receive an instrument.

20. A person watercraft as set forth in claim 19, wherein the intermediate number has an upstanding portion that divides the cavity into a forward part and a rearward part and through which a control mast extends for control of the watercraft.

21. A personal watercraft as set forth in claim 20, wherein the ventilating exhaust air conduit opens into the rearward portion of the cavity.

22. A personal watercraft comprised of a hull having an under-hull portion and a deck portion affixed together to define an engine compartment containing an internal combustion engine, said under-hull portion defining a tunnel at the rear end thereof, a jet propulsion unit contained at least in part in said tunnel and driven by said engine for propelling said watercraft, said engine having an exhaust port disposed on one side of a longitudinal center plane of the watercraft for discharging combustion products therefrom, a combined exhaust manifold, expansion chamber device and first transfer pipe for collecting exhaust gases from said exhaust port and delivering them transversely across said longitudinal plane, a watertrap device disposed on the other side of said longitudinal plane and extending at least in part along said tunnel, said first transfer pipe discharging the exhaust gases into said watertrap device, and a second transfer pipe extending from said watertrap device upwardly and transversely across said longitudinal center plane for discharging exhaust gases to the atmosphere.

23. A personal watercraft as set forth in claim 22, wherein the second transfer pipe discharges the exhaust gases into the tunnel.

24. A personal watercraft as set forth in claim 23, wherein the first transfer pipe extends transversely across the watercraft and extends vertically above an impeller shaft of the jet propulsion unit which is driven by the engine output shaft.

25. A personal watercraft comprised of a hull having an under-hull portion and a deck portion affixed together to define an engine compartment containing an internal combustion engine and at least one accessory therefor, a propulsion device driven by said engine for propelling said watercraft, a rider's area disposed to the rear of said hull and defined at least in major part by said deck portion, a forward part of said deck portion defining a ventilating air inlet facing in a generally forward direction and forwardly of said rider's area, a cavity formed by said deck portion at least in part above said engine compartment and receiving ventilating air from said ventilating air inlet, a ventilating inlet air conduit extending generally downwardly from said cavity from a point above the lower end thereof and contiguous to the ventilating air inlet for delivering ventilating air to the engine compartment, a ventilating exhaust air conduit extending upwardly from a rear portion of said engine compartment to the atmosphere, said ventilating air inlet being formed by a portion of the hull that defines a generally open discharge path extending from said ventilating air inlet and which overlies an upper portion of said cavity and further including an opening in the wall for delivering air from said discharge path to said cavity, and an instrument for providing information regarding the watercraft operation to an operator and disposed contiguous to the discharge end of the open discharge path.

26. A personal watercraft as set forth in claim 25, wherein the ventilating air inlet defining portion forms a shroud over the instrument.

27. A personal watercraft as set forth in claim 26, wherein the hull defines a storage compartment forwardly of the ventilating air inlet and spaced therefrom.

28. A personal watercraft comprised of a hull having an under-hull portion and a deck portion affixed together to define an engine compartment containing an internal combustion engine and at least one accessory therefor, a propulsion device driven by said engine for propelling said watercraft, a rider's area disposed to the rear of said hull and defined at least in major part by said deck portion, a forward part of said deck portion defining a ventilating air inlet facing in a generally forward direction, a cavity formed by said deck portion at least in part above said engine compartment and receiving ventilating air from said ventilating air inlet, a pair of ventilating inlet air conduits extending generally downwardly from said cavity from a point above the lower end thereof and contiguous to the ventilating air inlet for delivering ventilating air to the engine compartment, wherein each of said ventilating air conduits opening into said cavity on opposite sides of a longitudinally extending plane of the watercraft and terminating on the other side thereof so that said ventilating inlet air conduits cross over each other, and a ventilating exhaust air conduit extending upwardly from a rear portion of said engine compartment to the atmosphere.

29. A personal watercraft as set forth in claim 28, wherein the cavity is formed with a well to the rear of and below the upper openings of the ventilating air conduits.

30. A personal watercraft as set forth in claim 29, wherein the cavity extends rearwardly from its lowermost portion to an area beneath a seat for a rider disposed in the rider's compartment.

31. A personal watercraft as set forth in claim 30, wherein the ventilating exhaust air conduit discharges into the portion of the cavity beneath the seat.

* * * * *